US008528573B2

(12) United States Patent
Chudzik et al.

(10) Patent No.: US 8,528,573 B2
(45) Date of Patent: Sep. 10, 2013

(54) RESILIENT CLAW HAIR CLIP

(75) Inventors: Stan Chudzik, Alpharetta, GA (US); Michael Defenbaugh, Marietta, GA (US)

(73) Assignee: Goody Products Inc., Atlanta, GA (US)

( * ) Notice: Subject to any disclaimer, the term of this patent is extended or adjusted under 35 U.S.C. 154(b) by 0 days.

(21) Appl. No.: 13/223,013

(22) Filed: Aug. 31, 2011

(65) Prior Publication Data

US 2012/0048291 A1 Mar. 1, 2012

Related U.S. Application Data

(60) Provisional application No. 61/378,681, filed on Aug. 31, 2010.

(51) Int. Cl.

| | |
|---|---|
| ***A45D 8/00*** | (2006.01) |
| ***A45D 8/22*** | (2006.01) |
| ***A45D 8/28*** | (2006.01) |
| ***A45D 24/00*** | (2006.01) |
| ***A41F 1/00*** | (2006.01) |
| ***A41F 1/08*** | (2006.01) |
| ***A44B 1/04*** | (2006.01) |
| ***A44B 11/25*** | (2006.01) |
| ***A44B 17/00*** | (2006.01) |
| ***B42F 1/00*** | (2006.01) |
| ***B42F 1/02*** | (2006.01) |

(52) U.S. Cl.

USPC ..... 132/276; 132/273; 132/279; 132/156; 24/545

(58) Field of Classification Search

USPC ..... 132/276, 212, 106, 107, 126–138, 132/144–146, 148, 149, 156, 158, 152, 273, 132/245, 275, 277–279, 280, 282, 901, 159, 160, 200, 113; 24/559, 562, 545, 555, 563, 24/568, 561, 552, 530, 531, 557; D28/21, D28/28, 29, 32, 33, 39–43, 74

See application file for complete search history.

(56) References Cited

U.S. PATENT DOCUMENTS

| | | | | | |
|---|---|---|---|---|---|
| 621,705 | A | * | 3/1899 | Rasnick | 132/281 |
| 1,958,160 | A | * | 5/1934 | Cherico et al. | 24/331 |
| 2,029,043 | A | * | 1/1936 | Wendell et al. | 47/55 |
| 2,498,066 | A | * | 2/1950 | Challinor | 132/284 |
| 2,583,893 | A | * | 1/1952 | Shrosbree | 132/156 |
| 2,795,834 | A | * | 6/1957 | Szoke | 248/113 |
| 3,250,282 | A | | 5/1966 | Thatcher | |
| 3,384,935 | A | * | 5/1968 | Salvador | 24/557 |
| 3,711,905 | A | * | 1/1973 | Eckerdt et al. | 24/563 |

(Continued)

*Primary Examiner* — Vanitha Elgart

(74) *Attorney, Agent, or Firm* — Lempia Summerfield Katz LLC

(57) ABSTRACT

A hair clip has a body of a resilient material and first and second claws. The body has a dome shape and includes an outer perimeter, inner and outer surfaces, and a body plane defined generally by the perimeter. The body also includes a body axis generally central to the body and oriented generally perpendicular to the body plane. The first and second claws are coupled to and extend from the body in a generally axial direction relative to the body. The first and second claws are spaced from and generally opposite one another across the body. The hair clip is movable between an open and a closed position. In the open position, the body protrudes from the body plane in an inward axial direction and the first and second claws are separated from one another. In the closed position, portions of the first and second claws overlap one another.

22 Claims, 8 Drawing Sheets

(56) References Cited

U.S. PATENT DOCUMENTS

| | | | | | |
|---|---|---|---|---|---|
| 3,898,717 | A | * | 8/1975 | Schwartz | 24/561 |
| 4,292,714 | A | * | 10/1981 | Walker | 24/30.5 R |
| 5,261,428 | A | * | 11/1993 | Wu | 132/281 |
| 5,605,166 | A | * | 2/1997 | Chou | 132/279 |
| 5,699,814 | A | * | 12/1997 | Potut | 132/277 |
| 5,735,296 | A | * | 4/1998 | Chen | 132/277 |
| 5,785,065 | A | * | 7/1998 | Johnson | 132/275 |
| 5,787,905 | A | * | 8/1998 | Yasuda | 132/277 |
| 6,026,827 | A | * | 2/2000 | Revais | 132/277 |
| 6,082,371 | A | * | 7/2000 | Bader-Saltzman et al. | 132/276 |
| 6,142,159 | A | | 11/2000 | Lloyd | |
| 6,189,544 | B1 | * | 2/2001 | Potut | 132/277 |
| 7,231,925 | B1 | * | 6/2007 | Wall | 132/149 |
| 7,823,594 | B2 | * | 11/2010 | Defenbaugh et al. | 132/276 |
| 8,069,864 | B2 | * | 12/2011 | Chininis et al. | 132/277 |
| D669,217 | S | * | 10/2012 | Hsu | D28/39 |
| 2006/0124149 | A1 | * | 6/2006 | Salisbury et al. | 132/277 |
| 2008/0216862 | A1 | * | 9/2008 | Silva | 132/277 |
| 2009/0032047 | A1 | * | 2/2009 | Defenbaugh et al. | 132/210 |
| 2009/0255553 | A1 | * | 10/2009 | Hsu | 132/277 |

* cited by examiner

FIG. 1
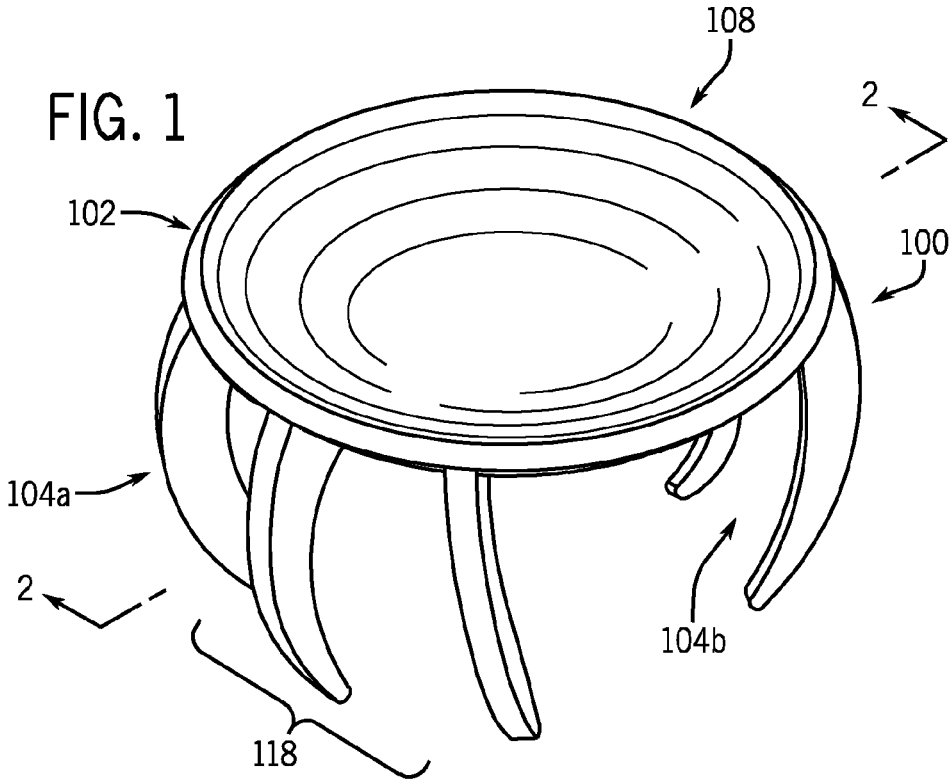
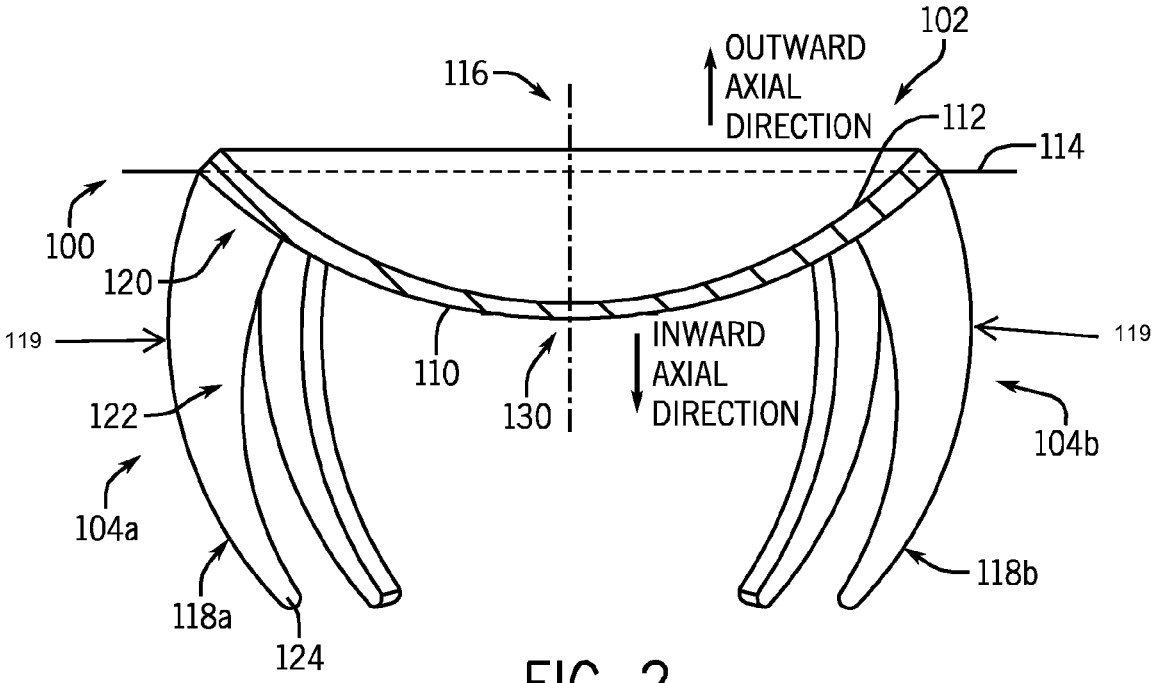
FIG. 2

RESILIENT CLAW HAIR CLIP

RELATED APPLICATION DATA

This patent is related to and claims priority benefit of U.S. provisional application Ser. No. 61/378,681 filed on Aug. 31, 2010 and entitled "Hair Clip." The entire contents of the above-noted prior filed provisional application are hereby incorporated herein by reference.

BACKGROUND OF THE INVENTION

1. Field of the Disclosure

The present disclosure is generally directed to hair clips, and more particularly to a resilient claw hair clip.

2. Description of Related Art

Conventional hair clips include two claws joined together with a hinge and spring. The two claws are often made of hard plastic. As a result, these claws frequently break into two or more pieces when the conventional hair clip is dropped and/or placed into a user's hair. The hinge and spring can also snag the hair or hurt the user's head when even a small amount of pressure is applied on, to, or against the hair clip, rendering conventional hair clips uncomfortable for use, especially during, for example, sleep and exercise. Aside from comfort issues associated with the spring, consumers often dislike the fact that the spring is visible on conventional clips. This, at least in the opinion of some consumers, makes the hair clip appear to be a lower quality or an inexpensive product. In addition, conventional hair clips must also be assembled by hand, such that they are often more expensive to manufacture.

In attempts to overcome some of these above-noted problems, conventional hair clips have been modified to include curved claws. The idea behind such a modification was to increase the surface area of the clip that contacts the user's head. This would, according to the idea, reduce any pain and/or discomfort caused by the clip. This solution did not, however, significantly increase the comfort level of the clip and/or alleviate the above-noted breakage problem. In other known alternative hair clips, the spring has been hidden to make the clip more aesthetically pleasing to the user. These clips are not, however, any more comfortable and/or sturdy than conventional hair clips. U.S. Pat. No. 6,142,159 discloses a hair clip without a spring. Because of the shape and structure of this hair clip, consumers have found the clip disclosed in the '159 patent to be difficult to use and just as uncomfortable as other known conventional hair clips.

SUMMARY

In one example according to the teachings of the present invention, a hair retaining clip has a body and first and second claws. The body is of a resilient material and has a dome shape and an outer perimeter. The body includes an inner surface, an outer surface, and a body plane defined generally by the perimeter. The body further includes a body axis that is generally central to the body and is oriented generally perpendicular to the body plane. The first and second claws are coupled to and extend from the body in a generally axial direction. The first and second claws are spaced from and generally opposite one another across the body. The hair retaining clip is movable between an open position and a closed position. In the open position, the body protrudes from the body plane in an inward axial direction and the first and second claws are separated from one another. In the closed position, portions of the first and second claws overlap one another.

In one example, the first and second claws can be coupled to and extend from the inner surface of the body. When the hair retaining clip is in the closed position, the body can protrude from the body plane in an outward axial direction.

In one example, the body can pop over-center through the body plane between the open position and the closed position.

In one example, the inner surface of the body can have a generally convex shape when the hair retaining clip is in the open position. The outer surface of the body can have a generally convex shape when the hair retaining clip is in the closed position.

In one example, the body can have a generally semi-spherical dome shape and the perimeter can be generally circular.

In one example, the perimeter can be generally rectangular.

In one example, the first and second claws can each include a base attached to the inner surface of the body near the perimeter, a stalk extending away from the respective base, and a free end. Each of the first and second claws can decrease in thickness between the respective base and free end.

In one example, the first and second claws can each include a plurality of fingers.

In one example, the first and second claws can each include three fingers.

In one example, the first and second claws can each include a plurality of fingers. Each of the plurality of fingers can have a base attached to the inner surface of the body near the perimeter, a stalk extending away from the respective base, and a free end. Each of the plurality of fingers can decrease in thickness between the respective base and free end.

In one example, the first and second claws can each include a plurality of fingers. The first and second claws can each further include a button positioned on one of the plurality of fingers. Each button can define a pressing surface that is configured to assist in moving the hair retaining clip between the open position and the closed position.

In one example, the first and second claws can each include a plurality of fingers. One of the plurality of fingers of each of the first and second claws can create a gusset connecting the inner surface of the body to the one finger.

In one example, the body can be made of a different material than the first and second claws.

In one example, the body can be made of an elastomer and the first and second claws can be made of plastic.

In one example, the hair retaining clip can further include a plurality of teeth positioned on the inner surface of the body near the perimeter and between the first and second claws.

In one example, the hair retaining clip can further include one or more holes through the body and radially inward of the perimeter.

In one example, the hair retaining clip can further include a plurality of holes through the body radially inward of the perimeter and arranged around the axis of the body.

In one example, the hair retaining clip can further include an adornment removably coupled to the outer surface of the body.

In one example, the hair retaining clip can further include one or more pairs of opposing tabs that extend radially outward from the perimeter.

In one example according to the teachings of the present invention, a hair clip is movable between an open position and a hair-retaining position. The hair clip has a resilient body, first and second claws, and a gripping portion. The resilient body has an inner surface, an outer surface, and a perimeter. The perimeter defines a body plane. The resilient body also has a body axis that is generally perpendicular to the body plane. The first and second claws are coupled to and extend axially away from the inner surface of the resilient body. The first and second claws are spaced from and generally opposite one another across the body. The gripping portion is positioned on a portion of the hair clip. The gripping portion is configured, when depressed, to move the hair clip from the hair-retaining position to the open position. The resilient body biases the hair clip to the hair retaining position without a separate biasing element.

In one example, the first and second claws can include a plurality of fingers with portions that are closely spaced or that overlap one another when the hair clip is in the hair retaining position.

In one example, the resilient body can bias the first and second claws away from one another when the hair clip is in the open position. The resilient body can bias the first and second claws toward one another when the hair clip is in the hair-retaining position.

BRIEF DESCRIPTION OF THE DRAWINGS

Objects, features, and advantages of the present invention will become apparent upon reading the following description in conjunction with the drawing figures, in which:

FIG. 1 shows a perspective view of one example of a hair clip constructed in accordance with the teachings of the present invention and in an open position.

FIG. 2 shows a cross-section view taken along line 2-2 of the hair clip of FIG. 1.

DETAILED DESCRIPTION OF THE DISCLOSURE

Figure 3:
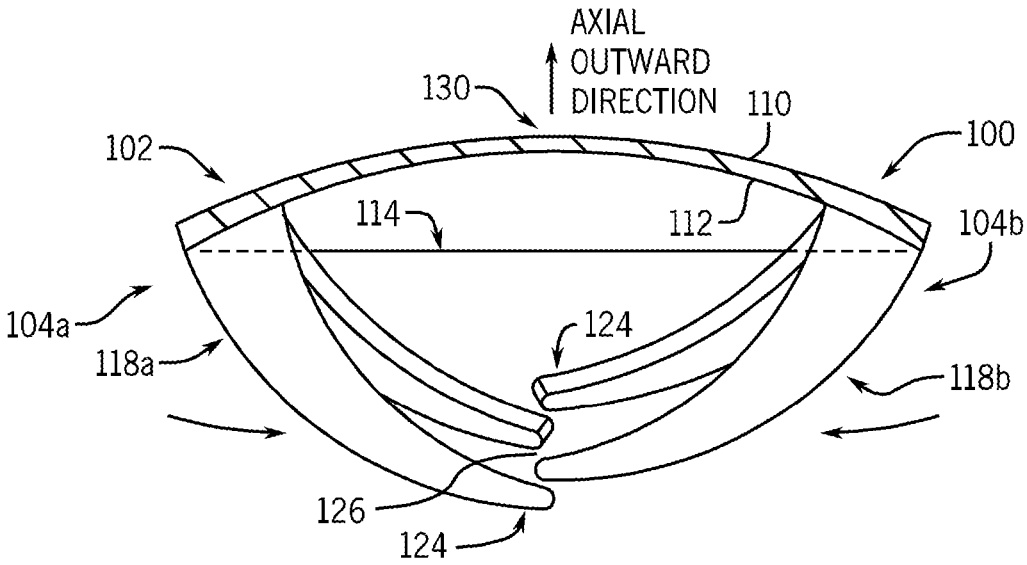
FIG. 3 shows a cross-section view taken along line 2-2 of the hair clip of FIG. 1 and moved to a closed or hair-retaining position.

The present invention is generally directed to hair clips that solve or improve upon one or more of the above-noted and/or other problems and disadvantages with known hair clips. The disclosed hair clips, in one example, include a resilient body and first and second claws coupled to and extending from the resilient body. The disclosed hair clips have a body that can bias the hair clip to the hair retaining or closed position without a need for a separate hinge and biasing element, such as a spring, as is typically employed in known hair clips. The disclosed hair clips further can include a gripping portion positioned on a portion of the hair clip. When the gripping portion is depressed, the hair clip is movable from the hair-retaining or closed position to the open position.

The disclosed hair clips provide a number of advantages over the prior art. The disclosed hair clips (i) are rigid enough to grip and securely retain hair, (ii) are also resilient or flexible enough on the user's head when pressure is applied to the clip, (iii) do not include separate and visible springs or hinges, (iv) have no pinch points, which are typically caused by a hinge and/or spring, and (v) have few failure modes. The resulting hair clips are more comfortable than known hair clips. The disclosed hair clips are particularly well suited for instances when conventional hair clips tend to be most uncomfortable, such as when a user is wearing the hair clip while exercising, seated in a car or airplane, or sleeping. The disclosed hair clips may also be more durable, more aesthetically pleasing, and easier and cheaper to manufacture than known hair clips.

Turning now to the drawings, FIGS. 1-4 depict one example of a hair retaining clip 100 constructed in accordance with the teachings of the present invention. In this example, the hair clip 100 includes a body 102 and first and second claws 104*a*, 104*b*, respectively. The first and second claws 104*a*, 104*b* are coupled to the body 102 as described below and are referred to herein generically as claws 104 and specifically as claws 104*a*, 104*b*. A similar convention for reference numbers is used herein with other examples as well.

In this example, the body 102 has a generally semi-spherical dome shape and a generally circular outer perimeter 108. The body 102 is of course not limited to this configuration, as the body 102 can, in other examples, have a generally square, rectangular, or otherwise irregular dome shape and/or a generally rectangular, square, triangular, etc., perimeter. The body 102 in this example includes an inner surface 110 and an outer surface 112 (see FIG. 2). The terms inner and outer are used herein as a matter of convenience and for reference only and related to the hair clip 100 when worn by a user. The inner surface faces the user's head and the outer surface is exposed and faces away from the user's head. As shown in FIG. 2, the outer perimeter 108 generally lies in a body plane 114. A body axis 116 generally passes through a center of the body 102 and is oriented generally perpendicular to the body plane 114. The body plane 114 and axis 116 are defined herein for reference.

In this example, the first and second claws 104 are coupled or attached to the inner surface 110 of the body 102. As shown in FIG. 2, the first and second claws 104 extend from the inner surface 110 in a generally inward (or downward when viewed in FIG. 2) axial direction. The first and second claws 104 are, in this example, spaced from and generally opposite one another across the body 102. As noted above and as one of ordinary skill in the art will realize, the orientation of the inner and outer surfaces and, likewise, the orientation of the inward and outward axial directions, can be reversed or inverted. For example, in some examples, the inner surface 110 can be referred to as the outer surface.

The first and second claws 104 each can include one or more curved fingers 118. As with the claws, the fingers are referred to generically as 118 and, when specific to a respective one of the claws 104*a* or 104*b*, are referred to as 118*a*,

118*b*, respectively. In one example (not shown), the first and second claws 104 each can include only one curved finger 118. In another example, the first and second claws 104 each include a plurality of curved fingers 118. In the illustrated example of FIG. 1, each of the first and second claws 104 includes three identically sized and shaped fingers 118. Though not specifically depicted herein, the fingers 118*a* of the first claw 104*a* are staggered or offset from, or relative to, the fingers 118*b* of the second claw 104*b*. This is so the fingers 118*a* will overlap, mesh, or intertwine with the fingers 118*b*, as described below, when the hair clip 100 is closed. In other examples, the fingers 118 need not be identically shaped and/or sized, as will be described in further detail below, and/or the fingers 118 can be aligned with one another (i.e. not staggered or offset from one another).

As shown in FIG. 2, each finger 118 also includes a generally thick base 120, a stalk 122, and a free end or tip 124 positioned or located radially inward of the rib 119. The base 120 is attached or connected to the inner surface 110 of the body 102 near or adjacent the outer perimeter 108. The stalk 122 extends away, in the axial inward direction, from the respective base 120, and leads to the free end 124. Each finger 118 in this example decreases in thickness between the respective base 120 and free end 124. As a result of the curved shape of the fingers 118, the free end 124 of each finger 118 is also positioned or located further from the body plane 114 than the respective base 120 and stalk 122.

In other examples, the shape, size, and/or orientation of each finger 118, or the components of each finger 118—the base 120, the stalk 122, and/or the free end 124—can vary from the example shown. For example, each finger 118 can have a constant thickness, cross-section, or diameter over its length. Each finger 118 can be attached to the body 102 at a different position or location, other than directly adjacent the perimeter 108 on the body 102.

FIG. 2 depicts the hair clip 100 in an open position. When the hair clip 100 is in the open position, the body 102 protrudes or extends from the body plane 114 in the axially inward direction. In this position, the dome shape and the inner surface 110 of the body 102 have a generally convex shape and the outer surface 112 is concave. Further, when the hair clip 100 is in the open position, the first and second claws 104 are biased away, separated, or spaced from one another by the curvature of the body 102. The first and second claws 104 are able to receive hair within the clip between the spaced apart claws in the open position.

Figure 4:
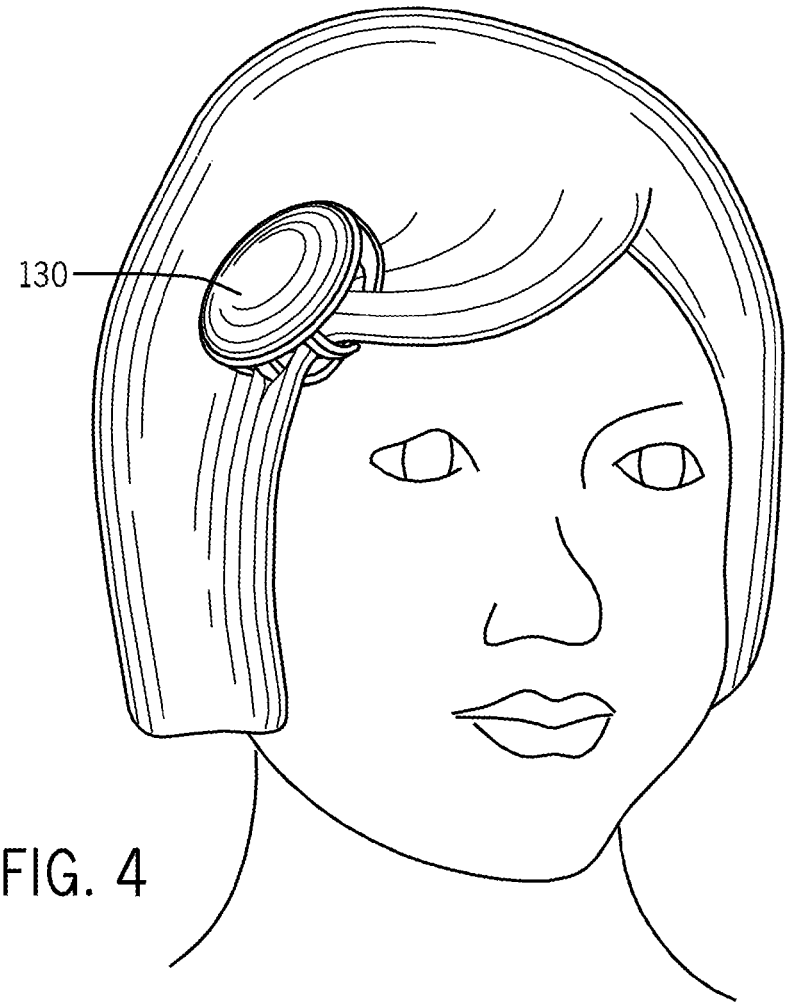
FIG. 4 shows the hair clip of FIG. 1 in the closed or hair-retaining position and secured in a user's hair.

FIGS. 3 and 4 depict the hair clip 100 in a closed or hair-retaining position. As shown in FIG. 3, when the hair clip 100 is in the closed position, the body 102 protrudes or extends from the body plane 114 in an axially outward direction. In this position, the outer surface 112 of the body 102 has a generally convex shape and the inner surface 110 is concave. Further, in the closed position, the first and second claws 104 are biased toward one another by the resilient body 102. The free ends 124 of the fingers 118*a* are closely spaced to or overlap or intersect the free ends 124 of the fingers 118*b* such that the fingers have no gap between them. As a result, hair-retaining spaces 126 are formed between the adjacent overlapping fingers 118. Also, a hair tunnel (not shown) is defined between the inner surface 110 of the body 102 and the closed fingers 118. When the hair clip 100 is in the closed position and is secured to or retained within a user's hair, the user's hair is received within the gaps 126 and the tunnel and is securely grasped or retained by the fingers 118, as shown in FIG. 4.

The hair clip 100 is movable between the open position of FIG. 2 and the closed position of FIGS. 3 and 4. Movement between the open position and the closed position can be accomplished, for example, by depressing a gripping portion or one or more pressure points positioned or located on a portion of the hair clip 100. In this example, the hair clip includes a pressure point 130 positioned or located on the dome of the body 102. In this example, the pressure point 130 is on or about at the center of the dome, i.e., at about the location of the body axis 116. When the pressure point 130 is depressed, the dome shape of the body 102 inverts or pops either axially inward or axially outward, which causes the hair clip 100 to move to the open or closed position, respectively, as desired.

More specifically, to move the hair clip 100 from the open position (FIG. 2) to the closed position (FIGS. 3 and 4), the gripping portion 130 is on the inner surface 110 and is depressed by applying a force to or pushing the body in the axially outward direction. In turn, the dome inverts, i.e. it reverses or pops inside out, in the axially outward direction over-center through the body plane 114. This causes the first and second claws 104 and, more particularly, the fingers 118 to move from the open position (FIG. 2) inward and toward one another to the closed position (FIG. 3). This is because the inner surface 110, to which the fingers 118 are attached, changes from a convex curvature to a concave curvature.

Conversely, to move the hair clip 100 from the closed position shown in FIGS. 3 and 4 to the open position shown in FIG. 2, the pressure point 130 is depressed by applying a force to or pushing on the body in the axially inward direction. In turn, the dome inverts, i.e. it reverses or pops inside out, in the axially inward direction and over-center through the body plane 114. This causes the first and second claws 104 and, more particularly, the fingers 118 to move from the closed position (FIGS. 3 and 4) outward and away from one another to the open position (FIG. 2). This is because the inner surface 110, to which the fingers 118 are attached, changes from a concave curvature to a convex curvature. If the clip 100 was previously secured in the user's hair, the clip can, as a result of the movement to the open position, be removed from the user's hair.

In other examples, the exact details regarding the open position, closed position, and/or movement between the open position and the closed position for the hair clip 100 can vary and yet the hair clip can still perform its intended purpose. Several alternate examples of hair clips are described to illustrate a few such variations.

As will be described in greater detail below, the hair clip 100 can be made from one material. Likewise, the hair clip 100, particularly the body 102, the first and second claws 104, and/or the gripping portions or pressure points 130, can be made from two or more different materials.

Figure 5:
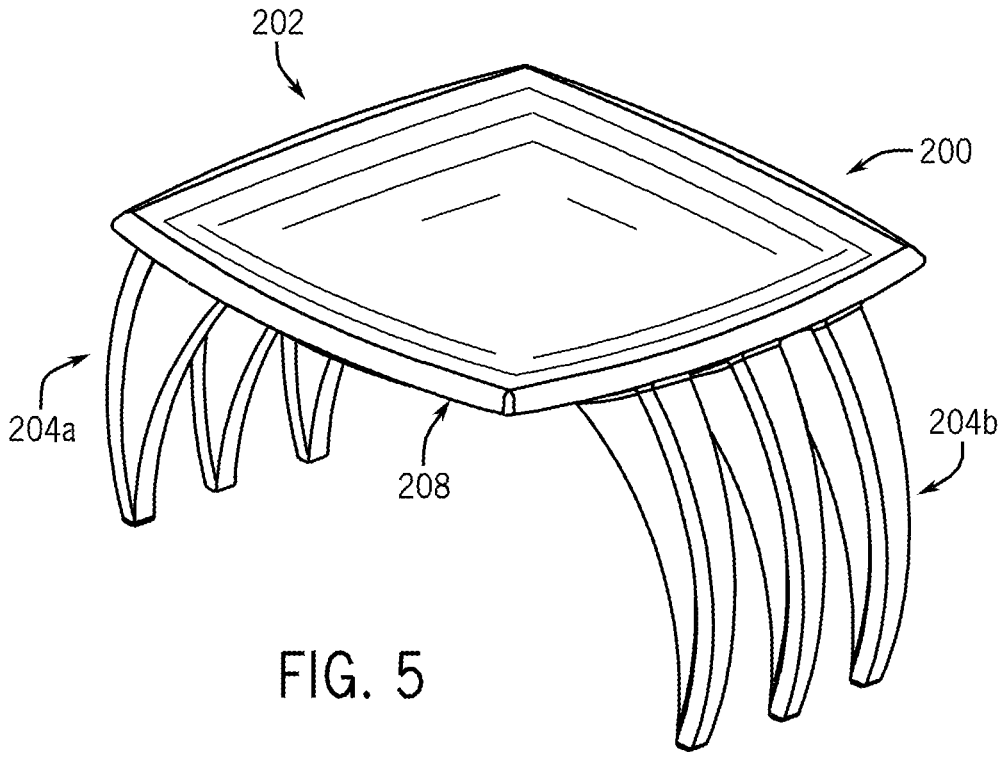
FIG. 5 shows a perspective view of another example of a hair clip constructed in accordance with the teachings of the present invention and in an open position.

FIG. 5 depicts another example of a hair clip 200 constructed in accordance with the teachings of the present invention. In this example, the hair clip 200 includes a body 202 and first and second claws 204*a*, 204*b*. The body 202 in this example has a dome shape that is similar, but not identical, to the dome shape of the hair clip 100 described above. As shown in FIG. 5, the body 202 also includes a generally rectangular perimeter 208. The first and second claws 204 in this example are similar to the first and second claws 104 described above. The first and second claws 204 are coupled to the body 202 just as the first and second claws 104 are coupled to the body 102. In other examples, though, the body 202 can be coupled to the first and second claws 204 differently than disclosed herein and yet still fall within the spirit and scope of the present disclosure.

Figure 6:
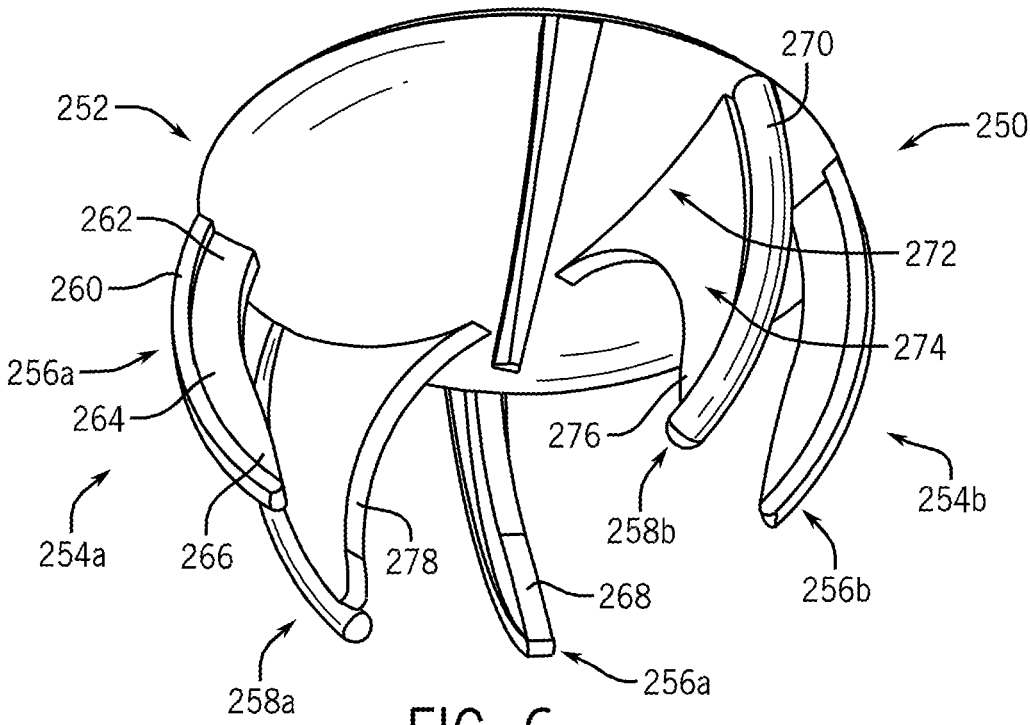
FIG. 6 shows a claw-side perspective view of another example of a hair clip constructed in accordance with the teachings of the present invention and in an open position.

FIG. 6 depicts another example of a hair clip 250 constructed in accordance with the teachings of the present invention. In this example, the hair clip 250 includes a body 252 and first and second claws 254*a*, 254*b*. The body 252 is essentially the same as the body 102 described above for the hair clip 100 and has the same components referenced by common reference numbers. Thus, no further details regarding the body 252 are described herein. The first and second claws 254 are coupled to the body 252 just as the first and second claws 104 are coupled to the body 102, as described above. In this example, each of the first and the second claws 254*a*, 254*b* includes two corresponding curved fingers 256*a*, 256*b* and a modified curved finger 258*a*, 258*b* centrally located or positioned between the two corresponding fingers 256*a*, 256*b*. The fingers 256 and 258 are attached or coupled to the body 102 just as the fingers 118 are attached or coupled to the body 102 of the hair clip 100, as described above. In other examples, the fingers 256 and 258 can be arranged differently. For example, one of the fingers 256 can be centrally located or positioned between the other of the fingers 256 and the modified finger 258 on each of the first and second claws 254*a*, 254*b*. In other examples, the hair clip 250 can include two, three, or more of the modified fingers 258.

As shown in FIG. 6, each finger 256 in this example includes a radially outward facing rib 260 that extends along the length of the finger. The rib 260 is attached to the inner surface 110 of the body 252 at or about the outer perimeter 108 of the body. Each finger 256 also includes a base 262, a stalk 264, and a free end or tip 266 positioned or located radially inward of the rib 260. The base 262, which is thinner than the base 120 of the hair clip 100 described above, is attached to the inner surface 110 of the body 252. The stalk 264 extends away, in the axial inward direction, from the respective base 262, and leads to the free end 266. As a result of the curved shape of the fingers 256, the free end 266 of each finger 256 is also positioned or located further from the body plane 114 than the respective base 262 and stalk 264. As shown in FIG. 2, each finger 256 also includes an inward facing surface 268 that is radially inward of the rib 260, the base 262, the stalk 264, and the tip 266, and, like the rib 260, extends along the length of the finger.

Like the fingers 256, each finger 258 is curved. Each finger 258, however, has a different configuration between base and tip than the fingers 256. As shown in FIG. 6, each modified finger 258 includes a radially outward facing rib 270 that extends along the length of the finger. The rib 270 is attached to the inner surface 110 of the body 252 at or about the outer perimeter 108 of the body. Each modified finger 258 also includes a thick base 272, a stalk 274, and a free end or tip 276 positioned or located radially inward of the rib 270. The base 272, which is thicker than the base 120 of the hair clip 100 and the base 262 of the hair clip 250 described above, is attached to the inner surface 110 of the body 252. The stalk 274, which is thicker and has a greater curvature than the stalk 122 of the hair clip 100 and the stalk 264 of the hair clip 250 described above, extends away, in the axial inward direction, from the respective base 272, and leads to the free end 276. Each modified finger 258 in this example decreases in thickness between the respective base 272 and free end 276. As a result of the curved shape of the fingers 258, the free end 276 of each finger 258 is also positioned or located further from the body plane 114 than the respective base 272 and stalk 274. As shown in FIG. 2, each finger 258 also includes an inward facing surface 278 that is radially inward of the rib 270, the base 272, the stalk 274, and the tip 276, and, like the rib 270, extends along the length of the finger.

In one example, the fingers 256 and 258 can be made of the same material as one another and the body 252. In another example, the fingers 258 can be made from a different material than the body 252 and/or the fingers 256, further details of which are provided below.

As a result of their size and shape, the base 272 and the stalk 274 of each modified finger 258 in this example form or define a generally triangular-shaped gusset. The gusset is configured to help invert or pop the dome of the body 102 when it is desired to move the hair clip 250 from the closed position to the open position (or vice-versa).

Figure 7:
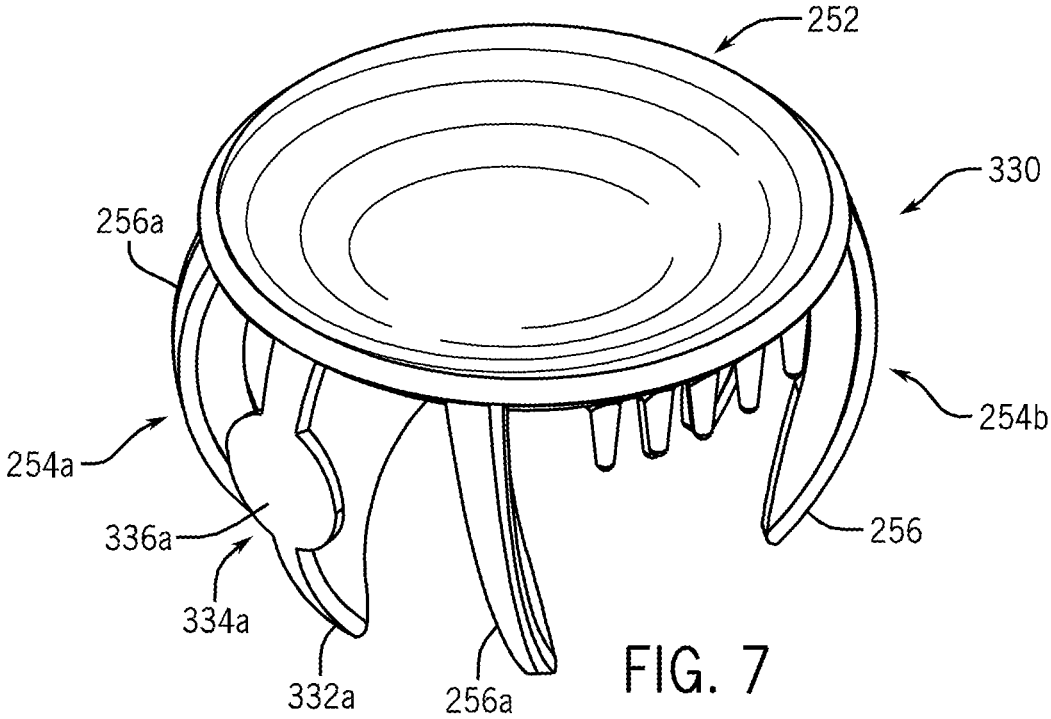
FIG. 7 shows a perspective view of another example of a hair clip constructed in accordance with the teachings of the present invention and in an open position.
Figure 8:
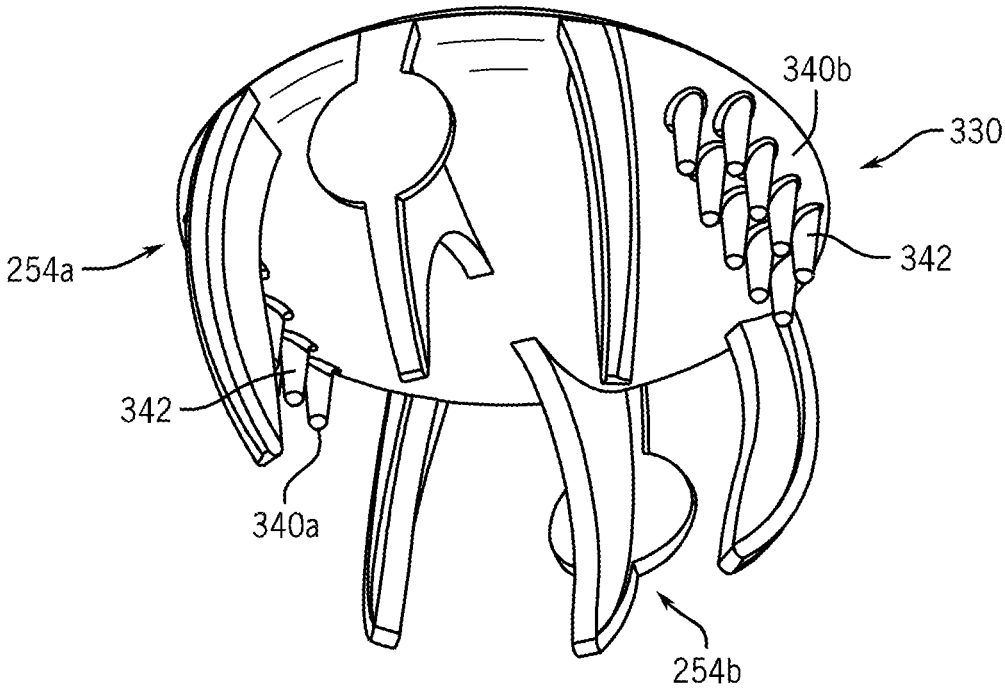
FIG. 8 shows a claw-side perspective view of the hair clip of FIG. 7.

In another example, shown in FIGS. 7 and 8, a hair clip 330, quite similar to the hair clip 250, can include one or more gripping portions or pressure points positioned or located on one of opposed pair of the fingers 256 or 258. In this example, the hair clip 330 has the same body 252 and claws 254 as the hair clip 250. The flanking fingers 256 are also the same. However, the central, modified fingers 332 in this example are different from the fingers 258. Each finger 332 includes the same rib 270, base 272, stalk 274, and free end 276 as the finger 258 described above, but each finger 332 in this example also includes circular gripping portions 334*a*, 334*b* (not shown) positioned or located on an exterior or radially outermost surface of the rib 270 of the modified fingers 332*a*, 332*b* (not shown). The gripping portions 334*a*, 334*b* define circular pressing surfaces 336, opposite one another across the claws 254, configured to assist in moving the hair retaining clip 330 between the open position and the closed position.

In other examples, the gripping portions can be rectangular, triangular, or any other shape. The gripping portions 330 also need not be positioned or located on the modified fingers 332. Alternatively, the gripping portion 330 can be positioned or located on one of the pair of fingers 256 of the hair clip 250 or 330. Further yet, each of the fingers 256, 258, and 332 can include the gripping portions 330 on the clips 250 or 330 in order to further assist a user in moving the hair retaining clips between the open position and the closed position. As with the fingers 258, the modified fingers 332 can, in one example, be made from a different material than the body 252 and/or the fingers 256. Alternatively, the fingers 256, 258, and 332 can be made from a different material than the body 252. Further details regarding the materials of these components are provided below.

In this example, the hair clip 330 can also include a plurality of teeth configured to aid in holding or gripping the user's hair when the hair clip is in the in-use position. In the example shown in FIGS. 7 and 8, the hair clip 330 includes a first set of teeth 340*a* and a second set of teeth 340*b*. As shown in FIG. 8, the first set of teeth 340*a* is spaced apart and opposite from the second set 340*b* another across the body 252. In this example, each tooth 342 of the first and second sets 340*a*, 340*b* is positioned on and extends in the inward axial direction from the inner surface 110 of the body 252 near the perimeter 108 of the body. Each set of teeth 340*a*, 340*b* is positioned between the first and second claws 254 as shown in FIG. 8. In other examples, the hair clip 330 can include more or less sets of teeth 340 and/or the sets of teeth can include more or less teeth 342 than what is depicted herein. Moreover, the sets of teeth 340 can be positioned or arranged differently relative to the body 252 and/or to one another. In one example, the teeth 342 can be made from a different material than the body 252 and/or the first and second claws 254, as will be described in greater detail below.

Figure 9:
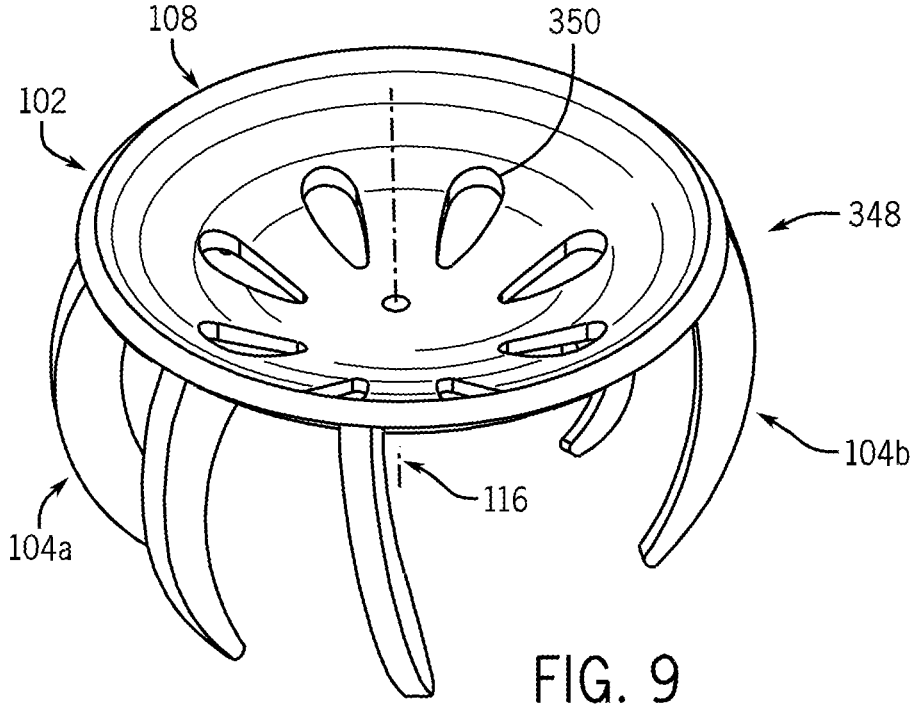
FIG. 9 shows a perspective view of another example of a hair clip constructed in accordance with the teachings of the present invention and in an open position.

In another example, shown in FIG. 9, a hair clip 348 is essentially identical to the hair clip 100 and has the same components referenced by common reference numbers. The hair clip 348 has one or more holes 350 through the body 102 and radially inward of the perimeter 108. In the example depicted by FIG. 9, the hair clip 348 includes a plurality of the holes 350 through the body 102. The holes 350 in this example are circumferentially arranged around the body axis 116. In other examples, the shape and/or size of the holes 350 can vary. Likewise, the one or more holes 350 can be arranged differently relative to the body axis 116 and/or the center of the body 102. The holes 350 can be provided as an ornamental or aesthetic enhancement and/or to reduce the amount of raw material needed to make the hair clip 348. The holes 350 may also be strategically placed to affect or improve the over-center function of the body 102.

Figure 10:
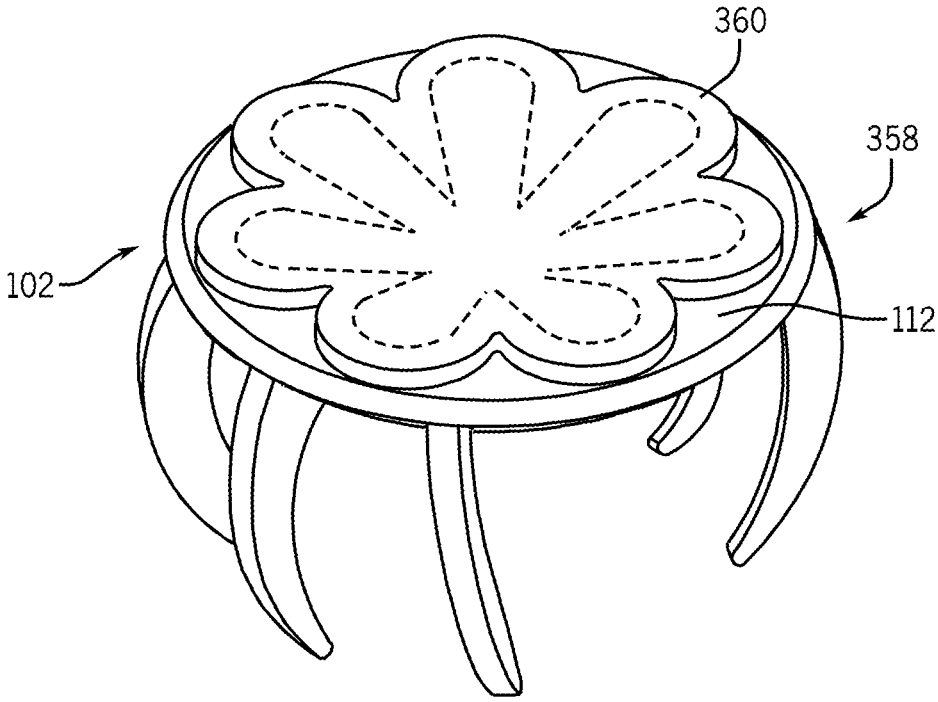
FIG. 10 shows a perspective view of another example of a hair clip constructed in accordance with the teachings of the present invention and in an open position.

In another example, shown in FIG. 10, a hair clip 358, also quite similar to the hair clip 100, can include an adornment 360 coupled or attached to the body 102 to provide a more fashionable and trendy hair clip. In this example, the adornment 360 can be removably coupled or attached to the outer surface 112 of the body 102. The adornment 360 can be snapped, clipped, glued, or otherwise secured to the outer surface 112 or any other part of the body 102. Since the adornment 360 is coupled to the outer surface 112, the adornment is on the outward facing side of the body 102 as shown in FIG. 10. Though not specifically depicted herein, the adornment 360 can be removed from the body 102 and replaced with other adornments having a different design, color scheme, and/or size. As a result, a number of adornments can be interchangeably used with the hair clip 358 to alter its appearance. The adornment 360 can also be made from a different material than the body 102, as will be described in greater detail below.

Figure 11:
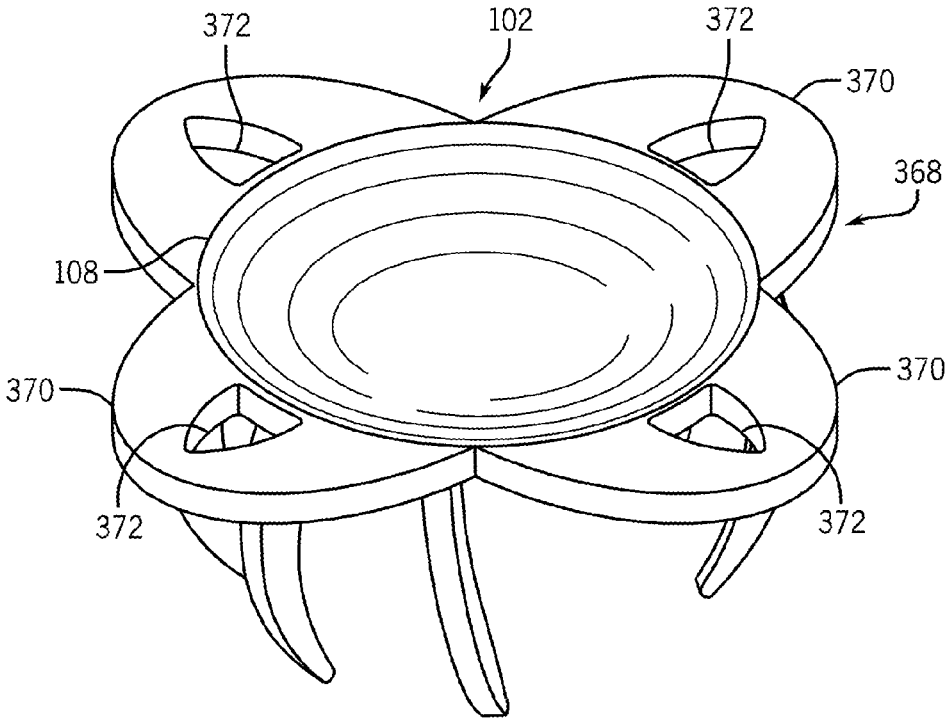
FIG. 11 shows a perspective view of another example of a hair clip constructed in accordance with the teachings of the present invention and in an open position.

In another example, shown in FIG. 11, a hair clip 368 can include one or more pairs of opposing tabs 370 that extend radially outward from the perimeter 108. The tabs 370 can be multi-purpose elements. In one example, the tabs 370 can provide alternative gripping portions or pressure points to facilitate moving of the hair clip between the open position and the closed position. In the example depicted by FIG. 11, two pairs of opposing tabs 370 are positioned circumferentially around and extend radially outward from the outer perimeter 108. Each tab 370 in this example has a generally semi-circular shape and an aperture 372 formed through the tab. In other examples, the tabs 370 can vary in size and/or shape and/or the tabs need not include the aperture 372. In other examples, the tabs 370 can serve an ornamental purpose. The tabs 370 can include any number of designs or colors to alter the appearance of the hair clip 368. In one example, the tabs 370 can be made from a different material than the body 102, further details of which will be provided below.

Figure 12:
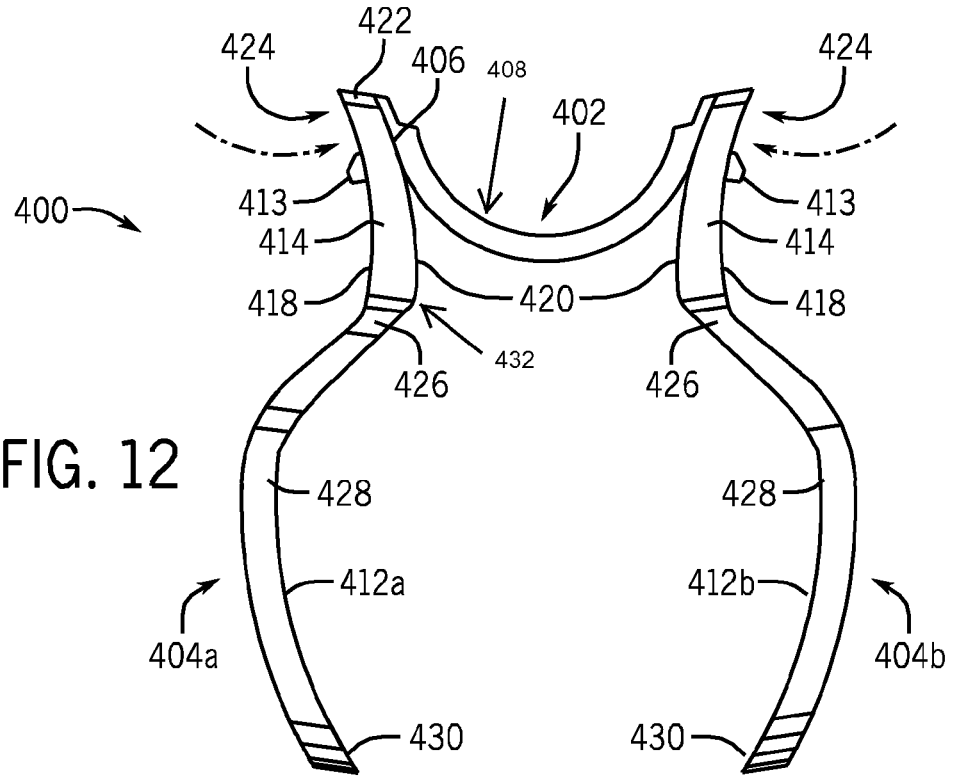
FIG. 12 shows an end view of another example of a hair clip constructed in accordance with the teachings of the present invention and in an open position.
Figure 13:
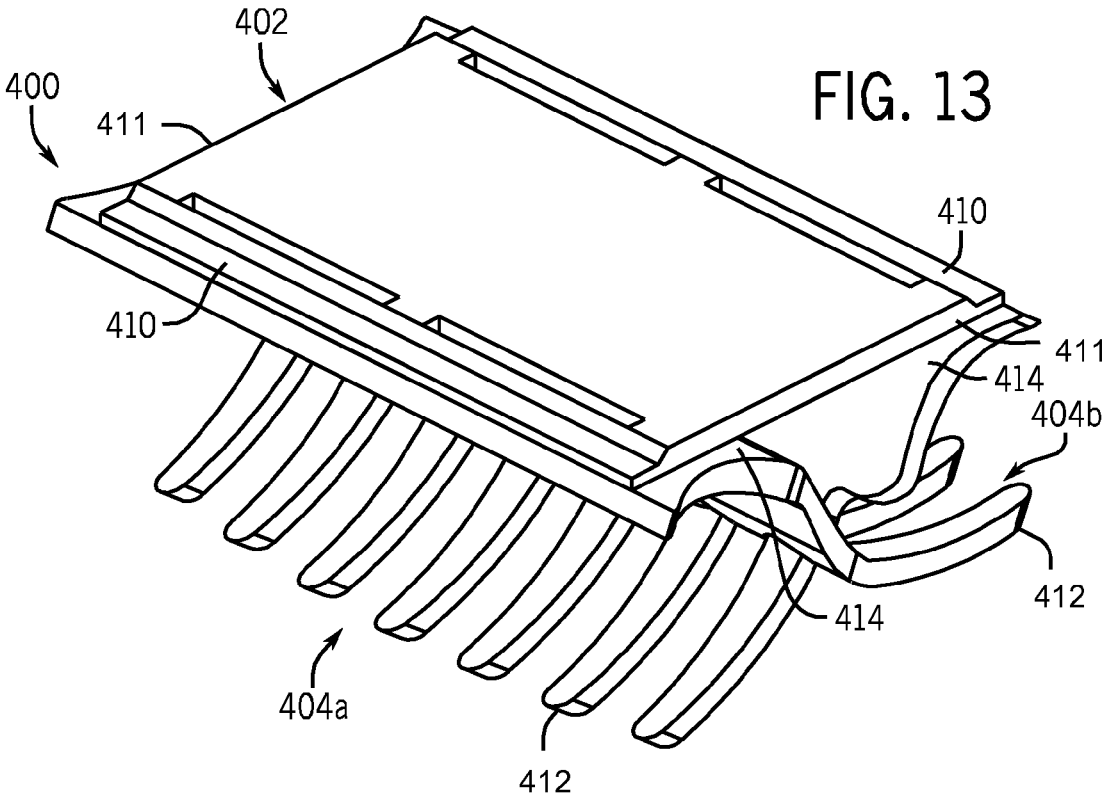
FIG. 13 shows a perspective view of the hair clip of FIG. 12 in the closed or hair-retaining position.

FIGS. 12 and 13 depict another example of a hair clip 400 constructed in accordance with the teachings of the present invention. In this example, the hair clip 400 includes a body 402 and first and second claws 404*a*, 404*b*. The body 402 includes an inner surface 406 and an outer surface 408. As shown in FIG. 13, the body 402 is substantially or generally flat and has a rectangular shape. The body 402 has a pair of lengthwise side edges 410 and a pair of end edges 411. As shown in FIG. 12, the body 402 also includes a pair of catches 413 that project or extend from the inner surface at or near each lengthwise side edge 410. In this example, the body 402 is made of a resilient material that can bend but will spring back to its normally flat-shape when any load is released.

In this example, the first and second claws 404*a*, 404*b* each have an S-like shape formed or defined by a widthwise bridge 414 and a plurality of fingers 412 extending from the bridge. Each bridge 414 is coupled or attached to the inner surface 406 of the body 402. Each bridge 414 includes an outer surface 418 (see FIG. 13) and an inner surface 420 (see FIG. 12). An outermost or perimeter edge 422 of the outer surface 418 of the bridge 414 is coupled or attached to the inner surface 406 along a respective one of the lengthwise side edges 410 of the body 402, as shown in FIG. 12. The bridges 414 also each include an aperture (not shown) configured to receive and retain a respective catch 413 to secure the body 402 to the bridges 414. FIG. 12 illustrates how each catch 413 extends through the corresponding aperture. Of course, in other examples, the body 402 and the bridges 414 can be integrally molded (to form a one-piece structure) or can be connected together in any number of ways.

As shown in FIG. 12, each bridge 414 defines a gripping portion 424 on the inner surface 420. Each gripping portion 424 provides a user with a comfortable gripping surface and a means for initiating movement of the clip from the closed position (FIG. 13) to the open position (FIG. 12), as will be described in greater detail below.

As shown in FIG. 13, each bridge 414 extends in the axially inward direction and leads to the plurality of fingers 412. The fingers 412 on each of the first and second claws 404 in this example are identically shaped and sized. The curved fingers 412*a* of the first claw 404*a* are staggered or offset from, or relative to, the fingers 412*b* of the second claw 404*b*. This is so the fingers 412*a* will overlap, mesh, or intertwine with the fingers 412*b*, as described below, when the hair clip 400 is closed.

Each curved finger 412 in this example has a base 426, a stalk 428, and a free end 430. The base 426 is coupled to an innermost edge 432 of the bridge 414 as shown in FIG. 12. The stalk 428 extends away from the respective base 426 and leads to the free end 430. Each curved finger 412 in this example maintains a relatively consistent thickness throughout, though the base 414 is a bit wider than the free end 416.

FIG. 12 depicts the hair clip 400 in the open position. To maintain the clip 400 in the open position, the gripping portions 424 are depressed and squeezed toward one another as shown. In the open position, the body 402 is bent along its length and forms a "U" shape in comparison to the generally flat shape of the body with the clip 400 in the closed position (see FIG. 13). Accordingly, the first and second claws 404 and, more particularly, the fingers 412, are separated or spaced apart from one other. The first and second claws 404 are thus ready to receive a user's hair.

FIG. 13 shows the hair clip 400 in the closed or hair-retaining position. When the clip 400 is in the closed position, the body 402 is substantially flat, as noted above. The first and second claws 404*a*, 404*b* and, more particularly, the free ends 430 of the respective fingers 412*a*, 412*b* overlap, cross, or mesh with one another such that the fingers close the gap previously therebetween. When the user inserts the hair clip 400 into his/her hair and the hair clip is closed, the free ends 430 of the fingers 412 grasp and retain the user's hair.

To move the clip from the open position (FIG. 12) to the closed position (FIG. 13), the gripping portions 424 need only be released. In turn, the body 402 will spring back to its substantially flat resting shape. This moves the curved fingers 412*a* of the first claw 404*a* and the fingers 412*b* of the second claw 404*b* back toward one another until the fingers reach the position shown in FIG. 13.

In other examples, the size, shape, and/or orientation of the body 402, the fingers 412*a*, 412*b*, and the gripping portions 424 can vary yet still fall within the spirit and scope of the present invention. For example, the body 402 need not be substantially flat, the fingers 412*a*, 412*b* can have or maintain a different shape or have a variable thickness throughout, and/or the gripping portions 424 can be positioned elsewhere or arranged differently on the body 402. Further yet, the exact details regarding the open position, closed position, and/or movement between the open position and the closed position for the hair clip 400 can vary and yet the hair clip can still perform its intended purpose. As will be described in greater detail below, the hair clip 400 can be made from one material. Likewise, the hair clip 400, particularly the body 402, the first and second claws 404, and/or the gripping portions 424, can be made from two or more different materials.

Figure 14:
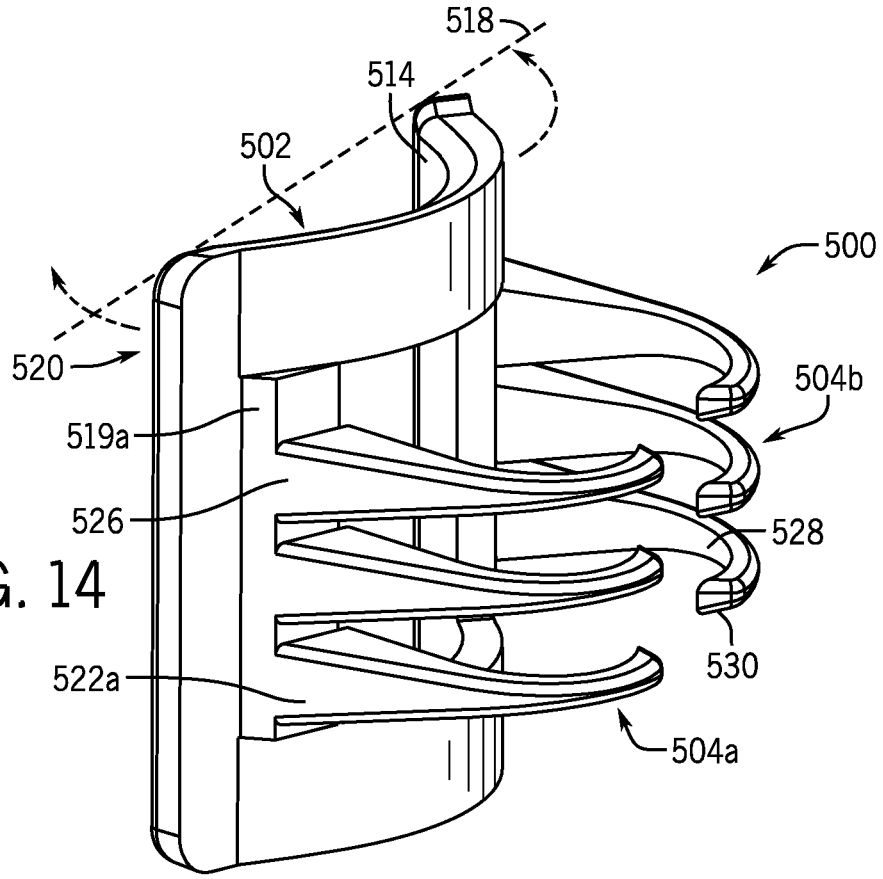
FIG. 14 shows a side view of another example of a hair clip constructed in accordance with the teachings of the present invention and in a partly open-position.
Figure 15:
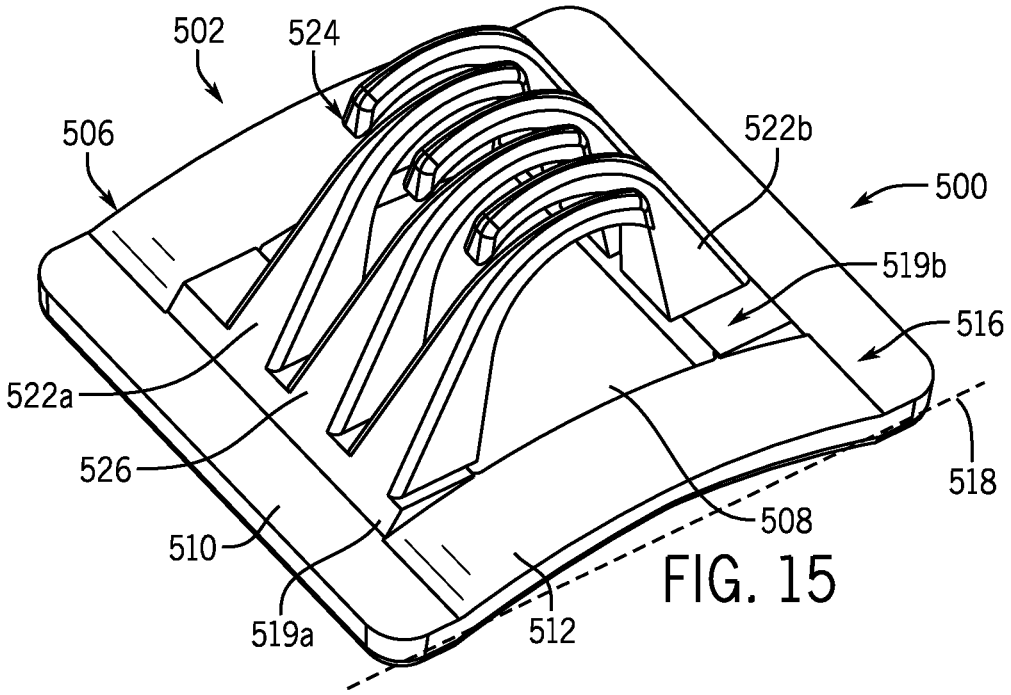
FIG. 15 shows a perspective view of the hair clip of FIG. 14 in the closed or hair-retaining position.

FIGS. 14 and 15 depict yet another example of a hair clip 500 constructed in accordance with the teachings of the present invention. In this example, the hair clip 500 includes a body 502 and first and second claws 504*a*, 504*b*. The first and second claws 504 are generally coupled or attached to the body 502.

As seen in FIG. 15, the body 502 in this example is slightly curved instead of being flat in its at rest or natural state. The body 502 has a generally rectangular outer frame 506 surrounding an interior opening 508. The perimeter frame 506 has a pair of lengthwise sides 510 and a pair of widthwise ends 512. As with the body 102 and the body 402, the body 502 is made of a resilient material that can bend but will return to its natural state such that it biases the hair clip 500 to the closed or in-use position shown in FIG. 15. The body 502 also includes an inner surface 514 and an outer surface 516 (see FIG. 14). As shown in FIG. 15, the sides of the perimeter frame 506 generally define a body plane 518.

In this example, the first and second claws 504 are coupled or attached to the sides 510 of the body 502. As shown in FIG. 15, the first and second claws 504 have bridges 519*a*, 519*b* and fingers 522*a*, 522*b* extending therefrom. The bridges 519*a*, 519*b* lie along inside edges of the sides 510 in the interior opening 510. As shown in FIG. 14, a gripping portion 520 is formed by each of the sides 510 of the inner surface 514 of the body 502. Each gripping portion 520 provides a user with a comfortable gripping surface and a means for initiating movement of the clip from the closed position (FIG. 15) to the open position (FIG. 14), as described in greater detail below.

The first and second claws 504*a*, 504*b* can each generally include one or more of the curved fingers 522*a*, 522*b*. In this example, the first and second claws 504 each include three identically sized and shaped curved fingers 522. As seen in FIG. 15, the fingers 522 of the first claw 504 are staggered or offset from, or relative to, the fingers 522 of the second claw 504. This is so the fingers 522*a* will overlap, mesh, or intertwine with the fingers 522*b*, as described below, when the hair clip 500 is closed As shown in FIGS. 14 and 15, each finger 522 in this example has a generally thick base 526, a stalk 528, and a free end or tip 530. The base 526 is attached or coupled to its respective bridge 519 defining part of the inner surface 514 on the body 502 and near the frame 506. The stalk 528 extends away, in the axial inward direction, from the respective base 526, and leads to the free end 530. Like each finger 118 of the above-described hair clip 100, each finger 522 decreases in thickness between the respective base 526 and the free end 530. As a result of the curved shape of the fingers 522, the free end 530 of each finger is also positioned or located further from the body plane 518 than the respective base 526 and stalk 528.

FIG. 14 depicts the hair clip 500 in the open position. To maintain the clip 500 in the open position, the gripping portions 520 are depressed and squeezed toward one another as shown by the arrows. In the open position, ends 512 of the body 502 are bent and form a "U" shape along the length of the body. The body 502 thus protrudes from the body plane 518 in an outward axial direction. Accordingly, the first and second claws 504 and, more particularly, the stalks 526 and the free ends 530 of the fingers 522, are separated or spaced apart from one other. The first and second claws 504 are thus ready to receive a user's hair.

FIG. 15 shows the hair clip 500 in the closed position where the body 502 is slightly curved, as described above. The first and second claws 504 and, more particularly, the free ends 530*a* of the fingers 522*a* overlap, intersect, or mesh with the free ends 530*b* of the fingers 522*b*. When closed, the free ends 530 of the fingers 522 align with one another about the same distance outward from the body plane 518. As a result, the fingers 522*a* and 522*b* close the widthwise gap therebetween when closed. When the user inserts the hair clip 500 into his/her hair and the hair clip is closed, the free ends 530 grasp and retain the user's hair.

To move the clip from the open position (FIG. 14) to the closed position (FIG. 15), the gripping portions 520 need only be released. In turn, the ends 512 of the body 502 straighten or return to their natural, substantially flat shape. This moves the curved fingers 522*a* of the first claw 504*a* and the fingers 522*b* of the second claw 504*b* toward one another until the curved fingers reach the closed, meshed position shown in FIG. 15.

In other examples, the size, shape, and/or orientation of the body 502, the gripping portions 520, and/or the fingers 522 can vary yet still fall within the spirit and scope of the present invention. For example, the body 502 can be flat, the frame perimeter 506 can be circular, the gripping portions 520 can be positioned elsewhere or arranged differently on the body 502, and the fingers 522 can have or maintain a different shape or have a variable thickness throughout. The frame shape 506 can also define a differently shaped opening, even one having a desired aesthetic appearance. Further yet, the exact details regarding the open position, closed position, and/or movement between the open position and the closed position for the hair clip 500 can vary and yet the clip can still perform its intended purpose. As will be described in greater detail below, the hair clip 500 can be made from one material. Likewise, the hair clip 500, particularly the body 502, the first and second claws 504, and/or the gripping portions 520, can be made from two or more different materials.

The hair clips 100, 200, 250, 330, 348, 358, 368, 400, and/or 500 can each be made from one or more than one material. In one example, the hair clip 100—including the body 102 and the first and second claws 104—can be made entirely of or from one material. For example, the entire hair clip 100 can be molded from a soft material such as plastic, rubber, an elastomer, a thermoplastic elastomer (TPE), or the like. In such examples, the fingers, bodies, and bridges, if any, would be formed as a single, integrated, unitary, and homogenous structure.

In other examples, the hair clips 100, 200, 250, 330, 348, 358, 368, 400, and/or 500 can be made from two or more different materials. In one example, the body 102 of the hair clip 100, particularly the dome, can be made from a first material and the first and second claws 104 of the hair clip 100 can be made from a second material that is harder or more rigid than the first material. For example, the dome can be molded from an elastomer, such as TPE, and the first and second claws 104 can be made of a plastic material, such as polyethylene (e.g., linear low polyethylene), ABS, polystyrene, or polycarbonate, that is harder than the elastomer body. The resultant clip can be dual molded from the two different materials, thereby producing an integral, unitary structure that is not homogenous. Such a configuration can permit the body 102 to flexibly move between the open and closed positions, can prevent components of the hair clip 100 from being easily broken, but can still allow the claws 104 to penetrate and securely grip a user's hair.

In another example, the hair clip 100 or any of the other hair clip examples can be over-molded or dual-injection molded with two different materials. For example, a pliable material, such as polypropylene, santoprene, or TPE, can be molded over a body made of a more rigid material, such as spring steel. The overmold can provide a pleasing tactile feel, look, and/or texture.

In these examples, a TPE having a durometer between 60 and 90 can be used. A softer TPE, having a durometer of less than sixty 60, may not provide sufficient clamping force necessary to penetrate and securely grip the user's hair. On the other hand, a harder TPE, having a durometer of greater than ninety 90, may be susceptible to tearing and/or may not sufficiently bias the first and second claws 104 in the open and/or closed position. In one example, a TPE having a durometer of 84 can be used. This can provide the hair clip 100 with the flexibility necessary to move between the open and closed position and the rigidity necessary for durability and to to securely retain or grip hair.

One having ordinary skill in the art will come to realize that the hair clips 100, 200, 250, 330, 348, 358, 368, 400, and/or 500, and the components of each of these hair clips can be made of one or more of these materials, or a variation thereof, and still fall within the spirit and scope of the present invention.

The hair clips 100, 200, 250, 330, 348, 358, 368, 400, and/or 500 can be manufactured in any number of ways. For example, the disclosed hair clips can be metal stamped, molded, fastened, or otherwise suitably manufactured.

Although certain hair clips and features thereof have been described herein in accordance with the teachings of the present disclosure, the scope of coverage of this patent is not limited thereto. On the contrary, this patent covers all embodiments of the teachings of the disclosure that fairly fall within the scope of permissible equivalents.

The invention claimed is:

1. A hair retaining clip comprising:

a body of a resilient material and having a dome shape, an outer perimeter, an inner surface, an outer surface, a body plane defined generally by the perimeter, and a body axis generally central to the body and oriented generally perpendicular to the body plane; and first and second claws coupled to and extending from the body in a generally axial direction, the first and second claws spaced from and generally opposite one another across the body, the first and second claws each including a plurality of fingers, each of the plurality of fingers having a base attached to the inner surface of the body near the perimeter, a stalk extending away from the respective base, and a free end, wherein a thickness of the base is greater than a thickness of the free end;

wherein the hair retaining clip is movable between an open position, in which the body protrudes from the body plane in an inward axial direction and the first and second claws are separated from one another, and a closed position in which the body protrudes from the body plane in an outward axial direction and portions of the fingers of the first and second claws overlap one another.

2. The hair retaining clip of claim 1, wherein the first and second claws are coupled to and extend from the inner surface of the body.

3. The hair retaining clip of claim 1, wherein the body pops over-center through the body plane between the open position and the closed position.

4. The hair retaining clip of claim 1, wherein the inner surface of the body has a generally convex shape when the hair retaining clip is in the open position, and the outer surface of the body has a generally convex shape when the hair retaining clip is in the closed position.

5. The hair retaining clip of claim 1, wherein the body has a generally semi-spherical dome shape and the perimeter is generally circular.

6. The hair retaining clip of claim 1, wherein the perimeter is generally rectangular.

7. The hair retaining clip of claim 1, wherein the first and second claws each include three fingers.

8. The hair retaining clip of claim 1, wherein the first and second claws each include a button positioned on one of the plurality of fingers, each button defining a pressing surface configured to assist in moving the hair retaining clip between the open position and the closed position.

9. The hair retaining clip of claim 1, wherein one of the plurality of fingers of each of the first and second claws creates a gusset connecting the inner surface of the body to the one finger.

10. The hair retaining clip of claim 1, wherein the body is made of a different material than the first and second claws.

11. The hair retaining clip of claim 10, wherein the body is made of an elastomer and the first and second claws are made of plastic.

12. The hair retaining clip of claim 1, further comprising a plurality of teeth positioned on the inner surface of the body near the perimeter and between the first and second claws.

13. The hair retaining clip of claim 1, further comprising one or more holes through the body and radially inward of the perimeter.

14. The hair retaining clip of claim 1, further comprising a plurality of holes through the body radially inward of the perimeter and arranged around the axis of the body.

15. The hair retaining clip of claim 1, further comprising an adornment removably coupled to the outer surface of the body.

16. The hair retaining clip of claim 1, further comprising one or more pairs of opposing tabs that extend radially outward from the perimeter.

17. A hair clip movable between an open position and a hair-retaining position comprising:

a resilient body having an inner surface, an outer surface, a perimeter defining a body plane, and a body axis generally perpendicular to the body plane;

first and second claws coupled to and extending axially away from the inner surface of the resilient body, the first and second claws spaced from and generally opposite one another across the body, the first and second claws each including a plurality of fingers; and a gripping portion formed on the inner surface at the perimeter of the resilient body and configured, when depressed, to move the hair clip from the hair-retaining position to the open position, wherein the resilient body biases the hair clip to the hair retaining position without a separate biasing element;

wherein portions of the fingers of the first claw overlap portions of the fingers of the second claw when the hair clip is in the hair retaining position.

18. The hair clip of claim 17, wherein the resilient body biases the first and second claws away from one another when the hair clip is in the open position and biases the first and second claws toward one another when the hair clip is in the hair-retaining position.

19. The hair retaining clip of claim 1, further comprising an adornment secured to a portion of the body.

20. The hair retaining clip of claim 1, wherein the fingers of the first and second claws are movable between the open position and the closed position, and wherein at least a portion of the movement between the open position and the closed position is in the body plane.

21. The hair retaining clip of claim 1, wherein the body has a generally irregular dome shape.

22. The hair retaining clip of claim 1, wherein the body has a generally irregular dome shape and the perimeter has an irregular shape.

* * * * *